US005863416A

United States Patent [19]

Lemke

[11] Patent Number: 5,863,416

[45] Date of Patent: Jan. 26, 1999

[54] METHOD TO VAPOR-PHASE DELIVER HEATER ANTIFOULANTS

[75] Inventor: Harald K. Lemke, Houston, Tex.

[73] Assignee: Nalco/Exxon Energy Chemicals, L.P., Sugar Land, Tex.

[21] Appl. No.: 734,056

[22] Filed: Oct. 18, 1996

[51] Int. Cl.[6] ..... C10G 9/12

[52] U.S. Cl. ..... 208/48 AA; 208/48 R; 585/950

[58] Field of Search ..... 208/48 AA, 48 R; 585/950

[56] References Cited

U.S. PATENT DOCUMENTS

| | | | |
|---|---|---|---|
| 3,531,394 | 9/1970 | Koszman | 208/48 |
| 3,837,803 | 9/1974 | Cater et al. | 21/2.7 |
| 3,951,837 | 4/1976 | Sheratte | 252/78 |
| 3,957,668 | 5/1976 | Sheratte | 252/78 |
| 4,024,048 | 5/1977 | Shell et al. | 208/48 AA |
| 4,024,049 | 5/1977 | Shell et al. | 208/48 AA |
| 4,024,050 | 5/1977 | Shell et al. | 208/48 AA |
| 4,024,051 | 5/1977 | Shell et al. | 208/348 |
| 4,105,540 | 8/1978 | Weinland | 208/48 AA |
| 4,176,045 | 11/1979 | Leftin et al. | 208/48 R |
| 4,226,700 | 10/1980 | Broom | 208/48 AA |
| 4,303,568 | 12/1981 | May et al. | 260/29.6 MP |
| 4,451,442 | 5/1984 | Jeffrey et al. | 423/224 |
| 4,452,253 | 6/1984 | Kaplan et al. | 585/650 |
| 4,599,480 | 7/1986 | Buddell et al. | 585/650 |
| 4,828,674 | 5/1989 | Forester | 208/48 AA |
| 4,830,838 | 5/1989 | Kent et al. | 423/226 |
| 4,835,332 | 5/1989 | Kisalus | 585/650 |
| 4,842,716 | 6/1989 | Kaplan et al. | 208/48 AA |
| 4,900,426 | 2/1990 | Kisalus | 208/48 AA |
| 5,354,450 | 10/1994 | Tong et al. | 208/48 AA |
| 5,360,531 | 11/1994 | Tong et al. | 208/48 AA |
| 5,446,229 | 8/1995 | Taylor et al. | 585/648 |
| 5,460,712 | 10/1995 | Lemke | 208/48 AA |

FOREIGN PATENT DOCUMENTS 222 324 A1 5/1985 Germany .

OTHER PUBLICATIONS

Production of Coke and Other Pyrolysis Products from Acetylene, Butadiene, and Benzene in Various Tubular Reactors, Albright/Yu, American Chemical Society 1979, Series 183, 193–203, no month.

Thermal Hydrogasifaction of Aromatic Compounds, Virk/Chabers/Woebcke, American Chemical Society 1974, Series 131, 237–257, no month.

The Mechanism of Thermal Decomposition of the Normal Olefins, Wheeler/Wood, Journal of the Chemical Society, 1819–1828, no month.

Coking Rates in a Laboratory Pyrolysis Furnance: Liquid Petroleum Feedstocks, Leftin/Newsome, Ing. Eng. Chem. Res. 1987, 26, 1003–1010, no month.

Secondary Reactions of Olefins in Pyrolysis of Petroleum Hydrocarbons, Sakai/Soma/Sasaki/TOminaga, Kunugi, Advances in Chemistry Series No. 97, 1970, 68–91, no month.

Tendencies of Aromatization in Steam Cracking of Hydrocarbons, Kopinke, Zimmermann/Ondruschka, Ind. Eng. Chem. Res. 1987, 26, 2393–2397, no month.

Formation of Solid Films From the Vapor Phase on High Temperature Surfaces, Makki/Graham, Journal of the Society of Tribologists and Lubrication Engineers, Mar. 1991, vo. 47, 3, 199–206.

Petroleum Refinery Engineering, ch. 7, pp. 248–260; ch. 8, pp. 265–268; ch. 17, pp. 547–554; ch. 19, pp. 678–693, no month.

*Primary Examiner*—Walter D. Griffin
*Assistant Examiner*—Nadine Preisch
*Attorney, Agent, or Firm*—Margaret M. Brumm; Thomas M. Breininger

[57] ABSTRACT

The present invention is a method of preventing fouling and coke formation on the high temperature sections of hydrocarbon processing equipment which comes into contact with a hydrocarbon fluid. The method comprises adding to a carrier prior to the carrier coming into contact with the high temperature sections of such equipment, an effective amount of an antifoulant in its vapor phase selected from the group consisting of tri-tertiary-butylphenol phosphate esters and compounds having the formula I:

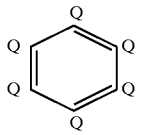

I wherein Q is Z, or R with the proviso that two occurrences of Q are Z, R is hydrogen, or a straight or branched alkyl group having from 1 to 7 carbon atoms, and only one or two occurrences of R may be alkyl. Z is represented by the formula II:

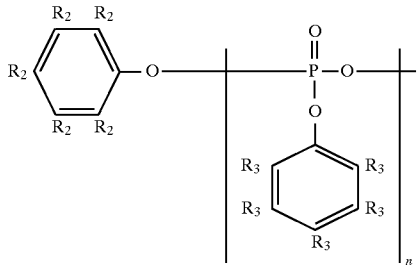

(II)

wherein $R_2$ and $R_3$ are the same as R and only one or two occurrences of each of $R_2$ and $R_3$ may be alkyl, and "n" is a whole number of from 1 to 9, and mixtures thereof.

32 Claims, No Drawings

METHOD TO VAPOR-PHASE DELIVER HEATER ANTIFOULANTS

This invention relates to a method of treating high temperature refinery equipment or petroleum fractions processed at high temperatures in such equipment to minimize the formation of foulants and coke in the equipment. The term "petroleum fractions" embraces crude oil, crude oil residues such as vacuum residue, and other petroleum fractions such as gas oil which are heated in the presence or absence of hydrogen in a manner to obtain lower boiling cracked products or to improve the handling of the material so treated.

Likewise, the additives of this invention may be successfully used to reduce fouling in coke in pyrolysis or cracking furnaces used to manufacture ethylene from the various gaseous and liquid petroleum fluids. The additives of this invention are tri-t-butylphenol phosphate ester or mono- and di-alkyl, aryl, alkaryl, cycloalkyl, alkenyl, and aralkyl phosphate esters such as phenol phosphate esters represented by the above formula. The phenol phosphate esters of this invention may be monomeric or may be oligomeric as where "n" in the above formula is a whole number greater than about 1.

In the high temperature treatment of crude oil or its fractions, and the like, fouling occurs on furnace coils, transfer lines, and exchangers due to coking and polymer deposition. The fouling problem is a major operational difficulty experienced in running ethylene plants, and in processes where heavy grades of petroleum are treated to reduce their molecular weight or to improve their handling characteristics including but not limited to visbreakers, delayed or fluid coking operations, hydrotreaters/hydrocrackers, and other processes. Depending on deposition rate, furnaces used for cracking petroleum fluids including ethylene plants, visbreakers, and the like, all must be periodically shut down for cleaning. The term fluid as used herein is intended to include the term feedstock.

In addition to periodic scheduled cleaning, shut downs are sometimes required due to sudden increases in pressure or temperatures resulting from deposit build-up on furnace coils and transfer line exchangers. Cleaning operations are expensive, both from a time and a labor standpoint, and are typically carried out either mechanically, or by a spalling or spalling steam/air burning step.

In the mechanical cleaning operation, also referred to as "pigging", deposits are brushed or scratched or otherwise mechanically removed from the surfaces of the equipment that is contact with the fluids and reaction products.

The cleaning method referred to as "spalling" wherein the temperature of the heater tubes is raised and lowered several times. Due to the difference in the contraction and expansion coefficients of the tubing material and the coke deposits, the coke deposits break up, allowing them to be blown out of the tubes.

The spalling process might be followed by a step in which a stream of air, steam, or a mixture thereof is blown into the equipment. During this step, the equipment is maintained at temperatures typically between about 500° C. and about 600° C. Typically, steam is first injected. The steam reacts with the coke deposits, burning off the deposits by converting the deposits to carbon oxides. After hours of treatment with the steam, most of the coke is normally burned off. To remove the remaining coke, air is gradually added to the steam.

Various additives have been used to attempt to minimize the formation of foulants in the high temperature processing of crude oil fractions. Among the materials that have been suggested include mono- and di-alkyl, aryl, alkaryl, cycloalkyl, alkenyl, and aralkyl phosphate esters, such as those exemplified in U.S. Pat. No. 4,105,540, which is hereinafter incorporated by reference into this specification. Other materials which have been used include dialkyl acid phosphate or phosphate esters in combination with thiodipropionates, such as those exemplified in U.S. Pat. No. 4,226,700, which is also hereinafter incorporated by reference into this specification and the mono- and di-phosphate and phosphate esters disclosed in U.S. Pat. Nos. 4,024,048, 4,024,049, 4,024,050 and 4,024,051, which are also each hereinafter incorporated by reference into this specification. In addition, the materials disclosed in U.S. Pat. Nos. 5,446,229, 5,460,712 and allowed application Ser. No. 08/427,915 are each hereinafter incorporated by reference into this specification.

While these phosphate materials, in general, have been successfully employed in some operations, use of these materials have proven unsatisfactory, leading to the occurrence of corrosion in units which have been so treated. It is theorized that while effective as antifoulants, the mono- and di-phosphate and phosphite esters suggested by the prior art hydrolyze at high temperatures yielding acidic corrosion products. In my copending related application, Ser. No. 08/427,915, filed Apr. 26, 1995, I disclosed the use of certain t-butylphenol phosphate esters as antifoulants. I have also discovered that the compounds having the formula I:

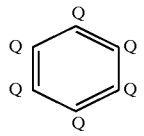

I wherein

Q is Z, or R with the proviso that two occurrences of Q are Z, R is hydrogen, or a straight or branched alkyl group having from 1 to 7 and most preferably from 1 to 4 carbon atoms, and only one or two occurrences of R may be alkyl;

Z is represented by the formula II:

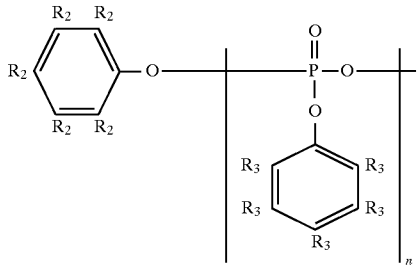

II wherein $R_2$ and $R_3$ are the same as R and only one or two occurrences of each of $R_2$ or $R_3$ may be alkyl, and "n" is a whole number from 1 to 9, preferably 1 to 5, and most preferably, "n" is 1 to 3 are good antifouling agents. In an especially preferred embodiment of the invention, "n" is 1, and R, $R_2$ and $R_3$ represent hydrogen.

The phosphate esters act as passivators under certain injection conditions. Once the metal surfaces of the hydrocarbon processing equipment are free of deposits, the antifoulant is introduced to the equipment as a vapor and mixed with a stream of air, steam, inert gas such as nitrogen, hydrocarbon gases, or a mixture thereof. If the antifoulant features a high oxidative stability, hydrolytic stability, and is present in the stream in the form of a diluted vapor, the antifoulant decomposes or degrades at the high temperatures in a specific pattern when contacted with the metallic tube surface. The decomposition fragments build up a film with coke suppressing features (in the form of a passivator film). The antifoulant is generally injected as a mixture with the stream of air, steam, inert gas such as nitrogen, hydrocarbon gases, or a mixture thereof. The injection of the antifoulant may be continued with the introduction of the hydrocarbon fluid. In addition, the injection of the antifoulant may be started and maintained during the injection of the hydrocarbon fluid, without first prepassivating the surfaces of the equipment that come into contact with the hydrocarbon fluid.

It is therefore an object of this invention to provide to the art a method for preventing and inhibiting the formation of foulants on surfaces in contact with hydrocarbon fluids defined herein as liquid, gaseous, or mixtures thereof of hydrocarbons.

It is a further object of this invention to provide to the art a method for inhibiting fouling in the high temperature processing of hydrocarbon fluids, especially crude oil fractions.

It is yet a still further object of this invention to provide to the art a method for preventing fouling in the high temperature section of petroleum processing equipment, including visbreakers, delayed cokers, ethylene furnace preheaters, and the like, using an effective amount of tri-t-butylphenol phosphate esters or compounds having the formula I:

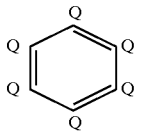

I wherein

Q is Z, or R with the proviso that two occurrences of Q are Z, R is hydrogen, or a straight or branched alkyl group having from 1 to 7 and most preferably from 1 to 4 carbon atoms, and only one or two occurrences of R may be alkyl;

Z is represented by the formula II:

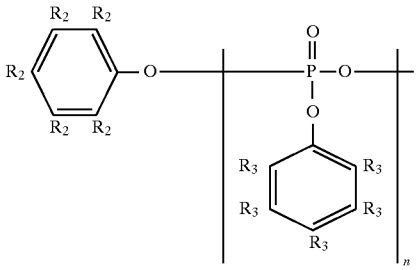

II wherein $R_2$ and $R_3$ are the same as R and only one or two occurrences of each of $R_2$ or $R_3$ may be alkyl, and "n" is a whole number from 1 to 9, preferably 1 to 5, and most preferably, "n" is 1 to 3. In an especially preferred embodiment of the invention, "n" is 1, and R, $R_2$ and $R_3$ represent hydrogen.

SUMMARY OF THE INVENTION

This invention is accordingly directed to a method of preventing fouling and coke formation on the high temperature sections of hydrocarbon processing equipment in contact with a hydrocarbon fluid which comprises adding to the hydrocarbon fluid prior to its contact with the high temperature sections of such hydrocarbon processing equipment an effective amount of tri-t-butylphenol phosphate ester or a compound having the formula I:

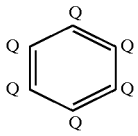

I wherein

Q is Z, or R with the proviso that two occurrences of Q are Z, R is hydrogen, or a straight or branched alkyl group having from 1 to 7 and most preferably from 1 to 4 carbon atoms, and only one or two occurrences of R may be alkyl;

Z is represented by the formula II:

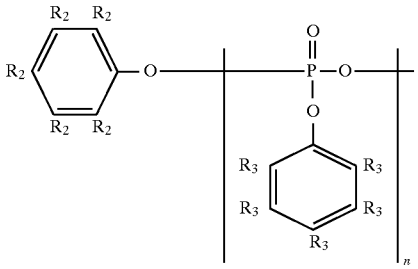

II wherein $R_2$ and $R_3$ are the same as R and only one or two occurrences of each of $R_2$ or $R_3$ may be alkyl, and "n" is a whole number from 1 to 9, preferably 1 to 5, and most preferably, "n" is 1 to 3. In an especially preferred embodiment of the invention, "n" is 1, and R, $R_2$ and $R_3$ represent hydrogen.

DESCRIPTION ON THE PREFERRED EMBODIMENTS

This invention is accordingly directed to a method of preventing fouling and coke formation on the high temperature sections of hydrocarbon processing equipment in contact with a hydrocarbon fluid which comprises adding to the hydrocarbon fluid prior to its contact with the high temperature sections of such hydrocarbon processing equipment an effective amount of tri-t-butylphenol phosphate ester or a compound having the formula I:

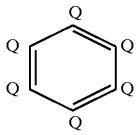

I wherein Q is Z, or R with the proviso that two occurrences of Q are Z, R is hydrogen, or a straight or branched alkyl group having from 1 to 7 and most preferably from 1 to 4 carbon atoms, and only one or two occurrences of R may be alkyl;

Z is represented by the formula II:

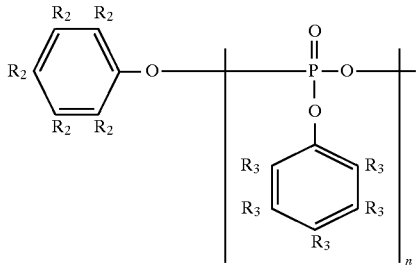

II wherein $R_2$ and $R_3$ are the same as R and only one or two occurrences of each of $R_2$ or $R_3$ may be alkyl, and "n" is a whole number from 1 to 9, preferably 1 to 5, and most preferably, "n" is 1 to 3. In an especially preferred embodiment of the invention, "n" is 1, and R, $R_2$ and $R_3$ represent hydrogen.

THE INVENTION

Compounds falling within the formula as disclosed above of the present invention are commercially available. Among the available materials is a product designated LDP-301 from the FMC Corporation. This product is believed, by chemical analysis to be a compound having the Formula III with a small amount of the structure of Formula IV.

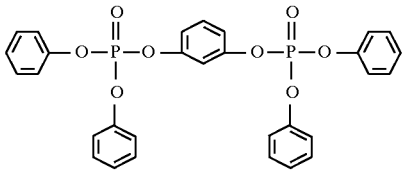

III

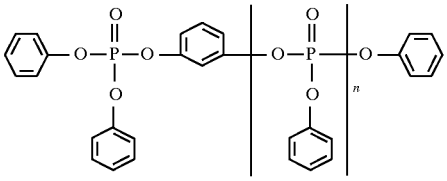

IV

LDP-301 is stated by its manufacture to be useful as a fire resistant base fluid or highly stable antiwear additive. LDP-301 is also recommended for use as an additive in carboxylic ester base fluids. LDP-301 is stated to have the following physical properties as set forth in Table I below:

TABLE I

| TYPICAL PROPERTIES | TEST METHOD | ASTM METHOD | |
|---|---|---|---|
| Appearance | Visual | | clear to amber viscous liquid |
| Odor | Olfactory | | None |
| Color | APHA | | 500 max. |
| Viscosity, cSt @ 100° F. | | D445 | 140–155 |
| cSt @ 210° F. | | | 10–12 |
| Total Acid Number mgKOH/g | | D974 | 0.20 max. |
| Specific Gravity @ 20/20° C. | | D1298 | 1.20–1.35 |
| Water Content | | D1744 | 0.1 max. |
| Flash Point, °C.(°F.), COC | | D92 | >300 (>572) |
| Fire Point, °C.(°F.) | | D92 | >300 (>572) |
| Autoignition Temp., °C.(°F.) | | E659 | 640 (1180) |
| Onset of Oxidation by DSC,°C.(°F.) | | D3350 | >350 (>644) |

TABLE I-continued

| TYPICAL PROPERTIES | TEST METHOD | ASTM METHOD | |
|---|---|---|---|
| Weight Loss by TGA °C.(°F.) | | 3850 | |
| 5% weight loss | | | 365 (690) |
| 10% weight loss | | | 400 (752) |
| Four Ball Wear Data, wear scar in mm (40 kg, 1200 rpm, 75° C., 1 hr) | | D2266 | |
| Polyol ester reference | | | 0.76 |
| Polyol + 2% LDP-301 | | | 0.44 |
| Diester reference fluid | | | 0.92 |
| Diester + 2% LDP-301 | | | 0.45 |

The tri-t-butylphenol phosphate esters used in the process of this invention are commercially available materials. In the practice of this invention, we prefer to use a material sold by FMC Corporation under the trade name Durad"620B. Table II lists physical properties of this material as provided by the manufacturer.

TABLE II

| PROPERTY | TYPICAL VALUE | ASTM METHOD |
|---|---|---|
| Flash Point °F. | 490 | D-92 |
| Auto Ignition °F. | 950 | D-659 |
| Viscosity 100° F. cst | 105–130 | D-445 |
| Total Acid Number mg KOH/gm | 0.05 | D-974 |
| Sp Gravity 20/20° C. | 1.124 | D-1298 |
| % Phosphorus (Xray F.) | 7.0 | — |

While t-butyl and non-substituted trimer phosphate ester materials are exemplified in related application Ser. No. 08/427,915, filed Apr. 26, 1995 which is hereinafter incorporated by reference into this specification, it has now been shown that other compounds such as cyclophosphazine (X-1P from Dow Chemical Company), and other oligomeric phenyl phosphate ester materials such as those described in the Formula I of the instant application also have superior activity as refinery antifoulant materials in vapor phase injection.

One embodiment of the invention is a method of preventing fouling and coke formation on the high temperature sections of hydrocarbon processing equipment which comes into contact with a hydrocarbon fluid. The method comprises adding to a carrier, typically a stream of air, steam, or a mixture thereof, prior to the carrier coming into contact with the high temperature sections of such hydrocarbon processing equipment, an effective amount of an antifoulant in its vapor phase selected from the group consisting of tri-tertiary-butylphenol phosphate esters and compounds having the formula I:

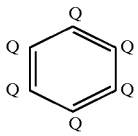

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

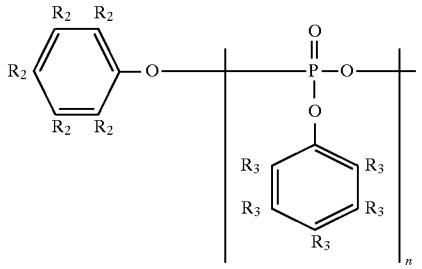

II wherein $R_2$ and $R_3$ are the same as R and only one or two occurrences of each of $R_2$ and $R_3$ may be alkyl, and "n" is a whole number of from 1 to 9, and mixtures thereof.

The high temperature section of the hydrocarbon processing equipment must be operated at a temperature of from at least about 240° C. to vaporize the antifoulant prior to the antifoulant contacting the surfaces of the processing equipment. The hydrocarbon processing equipment that is benefited from this invention is selected from the group consisting of: visbreakers; delayed cokers; preheaters; furnaces; transfer lines; exchangers; fluid catalytic crackers; hydrotreaters; hydrocrackers; and, furnace coils, specifically, but not limited to those units in front of catalytic units (examples of catalytic units are fluid catalytic crackers (FCC) and hydrocrackers).

Another embodiment of the present invention is a method of preventing fouling and coke formation on the surfaces of high temperature sections of hydrocarbon processing equipment which comes into contact with a hydrocarbon fluid. The processing equipment and/or carrier must be operated thereof at a temperature of at least about 240° C. The method comprises adding an effective amount of an antifoulant in its vapor phase selected from the group consisting of tri-tertiary-butylphenol phosphate esters and compounds of the following formula I to a carrier stream prior to its contacting the hydrocarbon processing equipment:

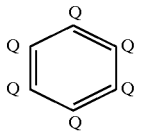

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

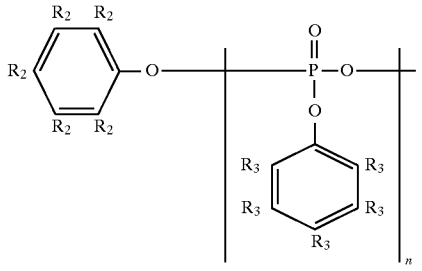

II wherein $R_2$ and $R_3$ are the same as R and only one or two occurrences of each of $R_2$ and $R_3$ may be alkyl, and "n" is a whole number of from 1 to 9, and mixtures thereof.

The antifoulant is added to the hydrocarbon processing equipment in a carrier selected from the group consisting of: steam; air; hydrocarbon gases; inert gases, such as nitrogen; and, mixtures thereof. The carrier stream containing the antifoulant may be added to a hydrocarbon fluid prior to its contacting the high temperature sections of the hydrocarbon processing equipment, it may be injected into the high temperature sections of the hydrocarbon processing equipment when a hydrocarbon fluid is not being processed or it can be injected into the high temperature sections of the hydrocarbon processing equipment both prior to and during the processing of a hydrocarbon fluid. The addition of the antifoulant, in or out of the presence of a hydrocarbon fluid, may be injected into the high temperature sections of the hydrocarbon processing equipment on a continuous basis or on an intermittent basis.

The processing equipment that may be benefited by the present invention includes visbreakers; delayed cokers; preheaters; furnaces; transfer lines; exchangers; fluid catalytic crackers; hydrotreaters; hydrocrackers; and, furnace coils, specifically, but not limited to those units in front of catalytic units (including FCC and hydrocrackers). The antifoulant may be added to the carrier stream of air, steam, or mixtures thereof prior to the introduction of the carrier into an ethylene furnace or a visbreaker.

Another embodiment of the invention is a method for inhibiting the formation of coke on the surfaces of high temperature sections of hydrocarbon processing equipment in contact with hydrocarbon fluid which comprises:

a. decoking the hydrocarbon processing equipment;

b. prior to processing a hydrocarbon fluid, adding to the processing equipment an antifoulant in its vapor phase selected from the group consisting of:

1. tri-tertiary-butylphenol phosphate esters;

2. compounds having the formula I:

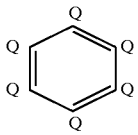

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

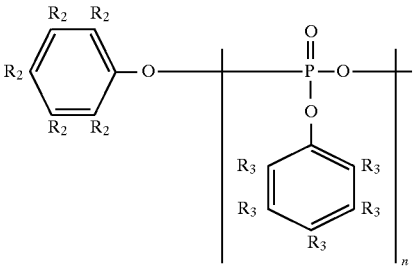

II wherein $R_2$ and $R_3$ are the same as R and only one or two occurrences of each of $R_2$ and $R_3$ may be alkyl, and "n" is a whole number of from 1 to 9; and, 3. mixtures thereof;

c. forming a thin coke layer on the surfaces of the processing equipment; and then, d. feeding the hydrocarbon fluid to the processing equipment.

The addition of the antifoulant may be discontinued during the processing of the hydrocarbon fluid or discontinued prior to the processing of the hydrocarbon fluid. The antifoulant may be added intermittently prior to the processing of the hydrocarbon fluid or continuously prior to the processing of the hydrocarbon fluid. The antifoulant may also be added intermittently during the processing of the hydrocarbon fluid or continuously during the processing of the hydrocarbon fluid.

The hydrocarbon fluid typically contains at least one fraction selected from the group consisting of: ethane; propane; butane; naphtha; kerosene; gas oil; and, residue. The antifoulant is added to the processing equipment in a carrier selected from the group consisting of: steam; air; hydrocarbon gases; inert gases; and, mixtures thereof.

The antifoulant is added, preferably, in a range of from about 0.0005% to less than about 10% on the basis of % by volume or % by mole of the carrier flow prior to processing hydrocarbon fluid, more preferably in a range of from about 0.001% to less than about 10% on the basis volume % of hydrocarbon fluid mass flow during the processing of the hydrocarbon fluid, and most preferably in a range of from about 0.005% to less than about 10% on the basis of carrier gas volume % or mole % during the prepassivation and from about 5 to about 2,000 parts per million (ppm) on the basis of mass of the hydrocarbon stream during the maintenance dosage.

It is important, as discussed above, that during the addition of the antifoulant, the processing equipment is maintained at a temperature of at least about 240° C. The processing equipment is typically operated between the temperatures of about 200° C. and about 1,200° C.

Another embodiment of the invention is a method for inhibiting the formation of coke on the surfaces high temperature sections of hydrocarbon processing equipment in contact with hydrocarbon fluid which comprises:

a. processing of a hydrocarbon fluid in the presence of an antifoulant in its vapor phase selected from the group consisting of:

1. tri-tertiary-butylphenol phosphate esters;

2. compounds having the formula I:

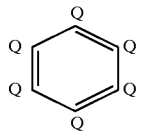

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

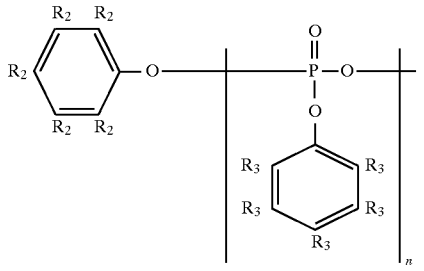

II wherein $R_2$ and $R_3$ are the same as R and only one or two occurrences of each of $R_2$ and $R_3$ may be alkyl, and "n" is a whole number of from 1 to 9; and, 3. mixtures thereof; and, b. forming a thin coke layer on the surfaces of the processing equipment, whereby the surfaces of the processing equipment are inhibited against formation of additional coke during the processing of a hydrocarbon fluid.

The antifoulant may be added intermittently during the processing of the hydrocarbon fluid or continuously during the processing of the hydrocarbon fluid. The hydrocarbon fluid may contain at least one fraction selected from the group consisting of: ethane; propane; butane; naphtha; kerosene; gas oil; and, residue. The antifoulant may be added in a range of from about 5 to about 2,000 ppm on the basis of hydrocarbon fluid mass flow during the processing of the hydrocarbon fluid. During the addition of the antifoulant, the processing equipment must be maintained at a temperature of at least about 240° C.

Another embodiment of the present invention is a method for increasing the run length of hydrocarbon processing equipment used to process a hydrocarbon fluid which comprises:

a. decoking processing equipment;

b. prior to processing a hydrocarbon fluid, adding to the processing equipment an antifoulant in its vapor phase selected from the group consisting of:

1. tri-tertiary-butylphenol phosphate esters;

2. compounds having the formula I:

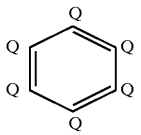

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

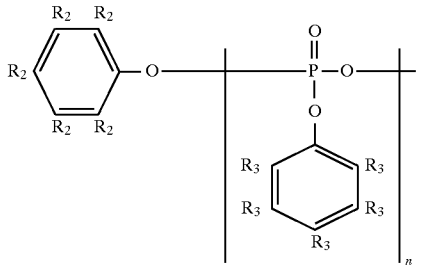

II wherein $R_2$ and $R_3$ are the same as R and only one or two occurrences of each of $R_2$ and $R_3$ may be alkyl, and "n" is a whole number of from 1 to 9; and, 3. mixtures thereof;

c. forming a thin coke layer on the surfaces of the processing equipment in contact with the hydrocarbon fluid; and then, d. feeding the hydrocarbon fluid to the processing equipment, whereby the surfaces of said processing equipment are inhibited against formation of additional coke during the processing of the hydrocarbon fluid thereby increasing the run length of the processing equipment.

Another embodiment of the present invention is a method for increasing the product yield from the processing of a hydrocarbon fluid through hydrocarbon processing equipment which comprises:

a. decoking processing equipment;

b. prior to processing a hydrocarbon fluid, adding to the processing equipment an antifoulant in its vapor phase selected from the group consisting of:

1. tri-tertiary-butylphenol phosphate esters;

2. compounds having the formula II:

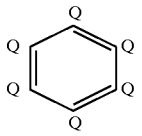

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

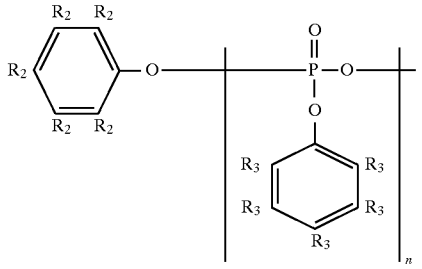

II wherein $R_2$ and $R_3$ are the same as R and only one or two occurrences of each of $R_2$ and $R_3$ may be alkyl, and "n" is a whole number of from 1 to 9; and, 3. mixtures thereof;

c. forming a thin coke layer on the surfaces of the processing equipment in contact with the hydrocarbon fluid; and then, d. feeding the hydrocarbon fluid to the processing equipment, whereby the surfaces of said processing equipment are inhibited against formation of additional coke during the processing of the hydrocarbon fluid thereby increasing the product yield from the processing of the hydrocarbon fluid through the processing equipment.

In the process of this invention the antifoulant materials represented by Formula I and the description of the tri-t-butylphenol phosphate ester are generally added to a petroleum fraction that will be subjected to a high temperature processing operation in an amount to provide from about 5 ppm to about 2,000 ppm of actives, preferably from about 5 ppm to about 1,000 ppm of actives, more preferably from about 5 ppm to about 500 ppm of actives, and most preferably from about 5 ppm to about 100 ppm of actives of the antifoulant, or mixtures thereof, as represented by Formula I or the tri-t-butylphenol phosphate ester as added to the hydrocarbon stream prior to the introduction of the stream into the high temperature processing area of the hydrocarbon processing equipment where the stream will be subjected to relatively severe conditions that can lead to the formation of polymers or coke. The additives of this invention are generally soluble in the hydrocarbon fluid to which it is applied, and in order for ease of application, may be diluted with common solvents, such as kerosene, heavy aromatic naphtha, or the like prior to its introduction into the system. Surprisingly, the material acts as an antifoulant in the high temperature processing of petroleum fractions to which it may be added.

What is meant by high temperature processing is temperatures ranging from as low as about 100° C., the boiling point of water to about 1,000° C. or higher. Generally, the additive of this invention is added to hydrocarbon fluids which will be subjected to temperatures in excess of about 330° C., (about 626° F.) at atmospheric pressure, the approximate temperature at which thermal cracking is initiated.

As stated earlier, the antifoulant process of this invention is applicable to a wide range of petroleum processing operations that are conducted at high temperature. Among the hydrocarbon processing operations to which this invention may find applicability are those operations where high molecular weight materials are cracked to produce lower molecular weight materials or to decrease their viscosity. These operations include hydrotreating, hydrocracking, coking, visbreaking, steam cracking, reforming, and the like. The materials may also be used in the feed materials going to pyrolysis or cracking furnaces to manufacture ethylene, and the like. The additives may be added to delayed cokers, preheaters, furnaces, refinery tubing, overhead lines, and other sections where hydrocarbon fluids are processed at or heated to high temperatures. The additives may further be added to the hydrocarbon fluid effluent coming out of any of the above described operations. Also, operation units that could benefit from treatment with the present invention is furnaces that are associated with atmospheric and vacuum distillation towers or other units that heat the crude oil before it is processed.

The addition of the claimed materials, tri-t-butylphenol phosphate ester or the compound represented by Formulas I and II, to the hydrocarbon processing equipment during the cleaning steps when the equipment is off-line (the feed of the hydrocarbon stream has been stopped) or to the hydrocarbon stream or effluent from a high temperature process section is thought to be particularly beneficial since it is thought that the high temperature sections destabilize certain components in the hydrocarbon fluids so treated and that the additive of this invention acts to prevent coke and foulant formation on the equipment sections that are contacted with the hot hydrocarbon fluids as they exit the heated sections.

The present invention characteristically may be practiced advantageously with any crude oil material, such as one selected from the group consisting of crude oils and reduced crude oils.

Typically, the phosphate ester materials of this invention are added to a crude oil material at a lower level of from about 5 ppm total weight basis to about 2,000 ppm total weight basis as the upper limit. It should be pointed out the upper limit will be limited by economics, and not the effect of the additive, and quantities greater than about 2,000 ppm of the additive may be added. Preferably, the total amount of the additive of this invention added during the cleaning step or to the hydrocarbon fluid material ranges from about 5 to about 2,000 ppm (same basis). In the processing of crude oils, heating times can vary enormously, as those skilled in the art of petroleum refining will readily appreciate, but are generally in the range of about from a few seconds to several hours, though longer and shorter time can be involved.

As used herein, the term "crude oil" can be considered to have reference to materials used as starting fluids for a petroleum crude oil refining operation, such as a petroleum having a substantially naturally occurring composition and which composition has not been appreciably altered through the use of distillation or pyrolysis. Examples of crude oils include many materials, such as refinery battery limit crudes (e.g. a crude as it exists in storage vessels preceding refining), degassed crude oils (e.g., a crude which has been stripped at temperatures typically in excess of from about 75° F. to about 125° F. to remove therefrom low boiling hydrocarbons, such as lower alkanes and other low volatiles), tar sand crudes (e.g., a product obtained from a destructive distillation of a tar sand), condensate crudes (e.g., a crude obtained by condensation of heavy ends from a natural gas well), shale oils, (e.g., a crude oil obtained from a natural gas well), shale oils, (e.g., a crude oil obtained from oil shale by destruction distillation followed by hydrotreating), desalted crude oils (e.g., a crude oil which has been subjected to a procedure whereby the content of mineral salts present in a starting crude oil is reduced typically to a salt content not above 5 pounds per 1,000 barrels, although the amount of salt remaining in de-salted crude can vary widely as those skilled in the art of petroleum sometimes overlap on one another and are not well defined. Presently preferred crude oil starting fluids for the present invention include battery limit crude oil, degassed crude oil, and desalted crude oil.

Similarly, as used herein, the term "reduced crude oil" can be considered to have reference to a starting crude oil fluid which has been subjected to distillation at temperatures which are generally above those employed for making a degassed crude oil using temperatures as above indicated, such as a residual crude oil (usually a liquid) which has not been substantially altered except as a result of heating and removing material therefrom by distillation of pyrolysis. Examples of reduced crude oil include a wide variety of materials, as those skilled in the refinery art will appreciate readily, such as topped crude oils (e.g., a product which results after gas oils boiling in the range of from about 400° F. to about 575° F. have been removed from a crude oil by fractional distillation), atmospheric residues (e.g., a product which results from the fractional distillation of a crude oil in an atmospheric pipe still and which boils above a temperature in the range of from about 350° F. to about 650° F.), viscous pitches (e.g., a product which results from a fractional distillation of an atmospheric residue in a vacuum still and which boils above a temperature in the range from about 1,000° F. to about 1500° F. at pressures of from about 1 to about 5 psig). Viscous pitches can be considered to include coker fluids. Presently preferred reduced crude oils include topped crude oils, atmospheric residues and viscous pitches.

The processing of crude oil materials in a refinery is a relatively well developed art. Characteristically and usually, the processing of crude petroleum comprises a successive series of steps. These steps characteristically and preferably are as follows:

A. heating a crude oil in at least one heat exchanger to a temperature typically in the range from about 100° F. to about 200° F., B. desalting the crude oil typically and preferably by the substeps of
   (1) turbulently mixing the crude oil which has been preferably first pre-heated as above indicated as typically from about 3 to about 8 parts by weight of water for each 100 parts by weight of such crude oil to form an emulsion of the water in oil type,
   (2) breaking said emulsion through the use of chemical agents, electrical means, or some combination thereof, and
   (3) separating the resulting aqueous phase from the resulting crude oil phase, C. further heating the resulting crude oil in at least one post desalter heat exchanger to a temperature typically in the range from about 200° F. to about 500° F., D. still further heating the resulting crude oil in a furnace to a temperature typically in the range from about 500° F. to about 700° F., E. charging the so-heated crude oil to an atmospheric still wherein such crude oil is progressively fractionally distilled at temperatures typically in the range from about 300° F. to about 650° F. under pressures typically ranging from and including atmospheric up to about 50 p.s.i.a. and collecting the distillates until an atmospheric residue results which boils above a temperature typically in the range from about 300° F. to about 650° F., F. heating said atmospheric residue in a vacuum furnace to a temperature typically in the range from about 650° F. to about 800° F. while maintaining a subatmospheric pressure of from about 5 to about 14 p.s.i.a. typically, G. charging the so-heated atmospheric residue to a vacuum still wherein such atmospheric residue is progressively fractionally distilled at a temperature typically in the range from about 800° F. to about 1,100° F. under pressure typically ranging from about 1 to about 5 p.s.i.a. and collecting distillates until a viscous pitch results typically boiling in the range from about 1,000° F. to about 1,500° F. at a sub-atmospheric pressure of typically from about 1 to about 5 p.s.i.a., and H. progressively heating the viscous pitch in a zone at temperatures typically ranging from about 860° F. to about 900° F. at pressures typically ranging from about 50 to about 350 psig for a time ranging from about 1second to about ½ hour.

In the case of step (H), the heating can occur either in a coker zone or in a thermal cracking zone. In the case of a coker zone, the heating is pyrolytic, and the distillates are collected, until a final solid residue is obtained which is a coke. In the case of a thermal cracking zone, the process involved is termed "visbreaking" and the distillates are collected without changing the fluid nature of the starting viscous pitch (as by forming coke). Residence times of the charged material (initially viscous pitch) in a coker zone typically extends for periods of time more than about 10 seconds with common coking times ranging from about 45 minutes to about 4 ½ hours. Residence times of starting pitch in a visbreaking operation in a thermal cracking zone typically are shorter than about 10 seconds maximum.

In the crude oil processing steps above described, a coker furnace can follow step (G) and precede step (H) so that after step (G) the following processing step sequence occurs after step (G) in place of step (H):

(H) heating said viscous pitch in a furnace to a temperature in the range from about 1,000° F. to about 1,500° F. (about 538° C. to about 816° C.) at near atmospheric pressure and passing said so heated pitch into a flash zone at temperatures typically in the range from about 860° F. to about 900° F. at pressures typically of from about 50 to about 350 p.s.i.g. Such flash zone can either be a coker zone or a visbreaking zone, as above indicated. If a coker zone, residence time in such zone is prolonged and pyrolysis occurs. If a visbreaker zone, residence time is brief and cracking occurs, giving rise to naphtha and gas oil as lighter products and producing a residuum which is less viscous than the charge stock.

These crude oil and reduced crude oil processing steps, as indicated, are well known to the art of petroleum refining and do not constitute as such part of the present invention. Those skilled in the art will appreciate that many variation, etc., can be used in any given hydrocarbon processing operation, involving, for examples, additional steps, substitute steps, recycle loops, and the like. The above summary is merely representative, but characteristic, of the sequence of steps typically found in a refinery when processing crude oil. Petroleum processing is discussed in such reference works as that by Nelson entitled *Petroleum Refinery Engineering*, see, for example, chapter 7, pp. 248–260; chapter 8, pp. 265–268; chapter 17, pp. 547–554; and, chapter 19, pp. 678–693. All such crude oil processing steps characteristically cause fouling of hydrocarbon processing equipment in absence of an additive or the like, as those skilled in the art well appreciate.

Fouling deposits apparently occur most frequently at temperatures between about 200° F. and about 1,800° F. (about 93° F. to about 982° C.), or even higher such as in, for example, certain ethylene furnaces.

The types of equipment affected most frequently include heat exchange surfaces, such as indicated above. The fouling deposits themselves are typically and principally polymerization products and are characteristically black in color. Some are initially gummy masses which convert to coke-like masses at elevated temperatures. Inorganic portions of such deposits frequently contain components, such as silica, iron-oxides, sulfur oxides, iron sulfides calcium oxide, magnesium oxide, inorganic chloride salts, sodium oxide, alumina, sodium sulfate, copper oxides, copper salts, and the like. These deposits are not readily solubilized by common organic solvents and these deposits are distinguishable from the corrosion and sludge formation sometimes occurring in finished products. Conventional antioxidants, stabilizing chemicals, and the like are characteristically relatively ineffective as antifoulants.

During a distillation or pyrolysis carried out with a crude oil material containing formula (1) and/or (2) material, this additive material is characteristically not carried over in the vapors evolved, but remains instead with the residue (reduced crude oil) involved. Chemical and physical changes may occur, of course, in such additive material during a given distillation or pyrolysis operation, but it is now theorized (and there is no intent herein to be found by theory) that by-products, degradation products, and the like, are not appreciably carried over with a vapor phase stream removed during a distillation or pyrolysis operation from a reduced crude oil.

The following procedures are presented to describe preferred embodiments and utilities of the invention and are not meant to limit the invention unless otherwise stated in the claims appended hereto.

One procedure in which the claimed materials could be applied is hot heaters wherein hydrocarbon fluid (hydrocarbon feedstock) are heated to a minimum temperature of about 240° C. within the thermal units. Such equipment includes, but is not limited to, crude heaters, vacuum heaters, visbreaker heaters, and delayed cokers. The fluid is heated in the heater section of the equipment to a preselected temperature.

In the case of a delayed coker heater, the heater charge is heated so that cracking occurs in the downstream reactor (also referred to as the coke drum). However, a certain amount of cracking takes place in the heater and leads to the undesired deposit formation (coking). The cracked light ends leave the coke drum through the coker overhead line and are charged as recycle back into the fractionator bottom. There it is combined with unrecycled material and recharged into the heater.

As the coke forms in the heater, the coke acts as an insulator, thereby decreasing the heat transfer process in the equipment. As a result, the equipment must be fired harder to maintain the heater outlet temperature. However, the equipment has a critical operating temperature, about 1,250° F. to about 1,350° F., above which the equipment cannot be safely operated. At that time, the equipment must be shut down and one or more of the cleaning methods, as described above, is carried out. A typical run on high temperature refinery equipment between cleaning procedures is between 6 days and 4 years in length, with the average run being about one year.

A pre-passivation step can be carried out on the high temperature refinery equipment which involves treating the surfaces of the equipment that typically comes into contact with the hydrocarbon fluid when the equipment is off-line, when the hydrocarbon fluid is not being processed.

The refinery equipment can be passivated using the following procedure. The temperature of the heater must be maintained at a temperature sufficient to maintain the temperature of an injection quill located upstream of the heater inlet at at least about 240° C. The quill needs to be positioned such that it can be maintained at a temperature of at least about 240° C. due to the radiant heat from the heater or by some other mechanism. To maintain the quill temperature at at least about 240° C., the heater, including the tubes in that location, typically must be maintained at at least about 300° C., more preferably at about 400° C.

The air flow, defined as the flow necessary to move the hydrocarbon fluid and other materials through the tubes, must also be maintained preferably heated to at least about 200° C. before it enters the heater or comes into contact with treatment materials such as the antifoulants of the instant invention. A typical air flow is about 2,000 $ft^3$/hour. The temperature of the air flow is extremely important if condensation of the treatment materials is to be avoided.

Once the air flow and the temperatures are stabilized, the pressure in the system will be about 40 lbs. The treatment materials, in this case, the claimed antifoulants, are injected through the quill at a concentration below about 10 volume percent (mole %). The antifoulant is vaporized in the quill. As the vaporized antifoulant reacts with the surface of the refinery equipment, a film of coke suppressing material is formed on the surfaces of the refinery equipment. A more detailed description of the mechanism is present in the article "Formation of Solid Films From the Vapor Phase on High Temperature Surfaces" by James Makki and Earl Graham and published in the *Journal of the Society of Tribologists and Lubrication Engineers*, vol. 47, 3, 199–206, incorporated herein by reference.

The antifoulant is fed into the heater at a rate of from about 0.5 gallon/day to about 3 gallons/day, more preferably from about 0.5 gallon/day to about 2 gallons/day, and most preferably from about 0.8 gallon/day to about 1.2 gallons/day, for from about 5 minutes to about 30 minutes, more preferably from about 5 minutes to about 20 minutes, and most preferably from about 5 minutes to about 15 minutes. Longer period of times may be employed, such as up to 3 days or longer, depending upon a variety of factors including the type of cleaning process, the hydrocarbon process to be employed, the type of equipment being treated, and the condition under which the hydrocarbon process is to be carried out.

The feed rate of the antifoulant can then be gradually increased so as not to interfere with the air flow through the equipment or otherwise shocking the system. The feed rate is increased from about 1 gallon/day to about 2 gallons/day, more preferably from about 1.2 gallons/day to about 1.9 gallons/day, and most preferably from about 1.4 gallons/day to about 1.8 gallons/day. This increased feed rate for the antifoulant to the heater should be maintained for at least from about 30 minutes to about 1 hour, more preferably for at least from about 2 hours to about 3 hours, and most preferably from about 4 hours to about 5 hours. As discussed above, longer period of times may be employed, such as up to 3 days or longer, depending upon a variety of factors including the type of cleaning process, the hydrocarbon process to be employed, the type of equipment being treated, and the condition under which the hydrocarbon process is to be carried out.

More than one injection quill can be used in this procedure. Multiple injection quills promote a more even treatment and coating of the surfaces of the equipment. An additional quill could be located downstream of the convection section of the refinery equipment such as at the shock tubes, the tubes that connect the convection section to the radiant section.

The heater must be maintained at a temperature sufficient to maintain the temperature of the an injection quill located upstream of the heater inlet at at least about 240° C. The quill needs to be positioned such that it can be maintained at a temperature of at least about 240° C. due to the radiant heat from the heater or by some other mechanism. To maintain the quill temperature at at least about 240° C., the heater, including the tubes in that location, typically must be maintained at at least about 300° C., more preferably at about 400° C.

The air flow, defined as the flow necessary to move the hydrocarbon fluid and other materials through the tubes, must also be maintained at or preferably heated to at least about 240° C. before it enters the heater or comes into contact with treatment materials such as the antifoulants of the instant invention. The typical air flow is about 2,000 $ft^3$/hour. The temperature of the air flow is extremely important if condensation of the treatment materials is to be avoided.

Once the air flow and the temperatures are stabilized, the pressure in the system will be about 40 lbs. The antifoulant is injected through the quill at a concentration below about 10 volume percent (mole %). The antifoulant vaporizes in the quill. As the vaporized antifoulant reacts with the surface of the refinery equipment, a film of coke suppressing material is formed on the surfaces of the refinery equipment.

The antifoulant is fed into the heater at a rate of from about 0.5 gallon/day to about 3 gallons/day, more preferably from about 0.5 gallon/day to about 2 gallons/day, and most preferably from about 0.8 gallon/day to about 1.2 gallons/day, for from about 5 minutes to about 30 minutes, more preferably from about 5 minutes to about 20 minutes, and most preferably from about 5 minutes to about 15 minutes.

The feed rate of the antifoulant can be gradually increased so as not to interfere with the air flow through the equipment or otherwise shocking the system. The feed rate is increased to from about 1 gallon/day to about 2 gallons/day, more preferably from about 1.2 gallons/day to about 1.9 gallons/day, and most preferably from about 1.4 gallons/day to about 1.8 gallons/day. This increased feed rate for the antifoulant to the heater should be maintained for at least from about 30 minutes to about 1 hour, more preferably for at least from about 2 hours to about 3 hours, and most preferably from about 4 hours to about 5 hours.

Another location of an injection quill is at the end of the radiant section. Using the "reversed flow burning", wherein air is forced in through the outlet of the radiant section. Using this procedure, the radiant section is most heavily coated with the film resulting from the reaction of the vaporized anti foulant and the surfaces of the refinery equipment.

In addition, a continuous treatment of the antifoulant can be used where the antifoulant is injected with the hydrocarbon fluid. As described above, the heater must be maintained at a temperature sufficient to maintain the temperature of the an injection quill located upstream of the heater inlet at at least about 240° C. The quill needs to be positioned such that it can be maintained at a temperature of at least about 240° C. due to the radiant heat from the heater or by some other mechanism. To maintain the quill temperature at at least about 240° C., the heater, including the tubes in that location, typically must be maintained at at least about 300° C., more preferably at about 400° C.

The air flow, defined as the flow necessary to move the hydrocarbon fluid and other materials through the tubes, must also be maintained at or preferably heated to at least about 240° C. before it enters the heater or comes into contact with treatment materials such as the antifoulants of the instant invention. The typical air flow is about 2,000 $ft^3$/hour. The temperature of the air flow is extremely important if condensation of the treatment materials is to be avoided. The hydrocarbon fluid feed is started.

Once the air flow, hydrocarbon fluid feed and the temperatures are stabilized, the pressure in the system will be about 40 lbs. The antifoulant is injected through the quill at a concentration below about 10 volume percent (mole %). The antifoulant vaporizes in the quill. As the vaporized antifoulant reacts with the surface of the refinery equipment, a film of coke suppressing material is formed on the surfaces of the refinery equipment.

The antifoulant is fed into the heater at a rate of from about 1 gallon/day to about 100 gallons/day, more preferably from about 4.0 gallons/day to about 7.0 gallons/day, and most preferably from about 4.5 gallons/day to about 6.5 gallons/day. The feed rate for the antifoulant is maintained for at least from about 1 day to about 3 year, more preferably for at least from about 1 day to about 180 days, and most preferably from about 1 day to about 120 days. Longer or shorter times may be employed, depending on a variety of factors including the type of hydrocarbon processing procedure being used, the type of equipment being treated, length of the run, and the conditions under which the process is carried out.

The antifoulant vapor in the hydrocarbon fluid would replenish the coating formed during the prepassivation process or creates a coating as the antifoulant vapor reacts with the surfaces of the of refinery equipment. However, this continuous treatment procedure can not be used in fluid catalytic crackers, hydrotreaters, hydrocrackers, or any other refinery equipment that contains a catalyst bed downstream of the heater unit.

Another application of the claimed antifoulants includes injecting one or more of the claimed antifoulant during an on-line despalling procedure. On-line despalling is where one or more lines (passages) of the heater are shut down and treated with steam and/or condensate to remove coke deposits in the line while the hydrocarbon fluid continues to be processed through the other lines of the heater. After the coke deposits have been removed, the temperature of the heater must be maintained at a temperature sufficient to maintain the temperature of an injection quill located upstream of the heater inlet at at least about 240° C. The quill needs to be positioned such that it can be maintained at a temperature of at least about 240° C. due to the radiant heat from the heater or by some other mechanism. To maintain the quill temperature at at least about 240° C., the heater, including the tubes in that location, typically must be maintained at at least about 300° C., more preferably at about 400° C.

It is obviously at the temperatures that the spalling process is carried out at, there would not be any concerns with proper vaporization of the one or more claimed antifoulants being injected into the line that is off-lined. Many of the commercially available antifoulants hydrolyze in the steam, steam/air, or air at despalling temperatures, causing additional problems without inhibiting or preventing coke deposits. The claimed antifoulants are much more stable under the harsh conditions of despalling and should be able to at least minimize the deposition of coke in refinery equipment.

The air flow, defined as the flow necessary to move the hydrocarbon fluid and other materials through the tubes, must also be maintained at or heated to at least about 240° C. before it enters the heater or comes into contact with treatment materials such as the antifoulants of the instant invention. A typical air flow is about 2,000 $ft^3$/hour. The temperature of the air flow is extremely important if condensation of the treatment materials is to be avoided.

Once the temperatures are stabilized, the pressure in the system will be about 40 lbs. The treatment materials, in this case, the claimed antifoulants, are injected through the quill at a concentration below about 10 volume percent (mole %). The antifoulant is vaporized in the quill. As the vaporized antifoulant reacts with the surface of the refinery equipment, a film of coke suppressing material is formed on the surfaces of the refinery equipment.

The antifoulant is fed into the heater at a rate of from about 0.5 gallon/day to about 3 gallons/day, more preferably from about 0.5 gallon/day to about 2 gallons/day, and most preferably from about 0.8 gallon/day to about 1.2 gallons/day, for from about 5 minutes to about 30 minutes, more preferably from about 5 minutes to about 20 minutes, and most preferably from about 5 minutes to about 15 minutes. The dosages and the treatment times will vary markedly depending on a variety of factors including the type of process being used, the type of equipment being treated, and the conditions under which the process is carried out.

The feed rate of the antifoulant can be gradually increased so as not to interfere with the air flow through the equipment or otherwise shocking the system. The feed rate is increased to from about 1 gallon/day to about 2 gallons/day, more preferably from about 1.2 gallons/day to about 1.9 gallons/day, and most preferably from about 1.4 gallons/day to about 1.8 gallons/day. This increased feed rate for the antifoulant to the heater should be maintained for at least from about 30 minutes to about 1 hour, more preferably for at least from about 2 hours to about 3 hours, and most preferably from about 4 hours to about 5 hours.

Changes can be made in the composition, operation and arrangement of the method of the present invention described herein without departing from the concept and scope of the invention as defined in the following claims:

I claim:

1. A method of preventing fouling and coke formation on the surfaces of high temperature sections of hydrocarbon processing equipment in contact with a hydrocarbon fluid which comprises adding to said hydrocarbon processing equipment an effective amount of an antifoulant in its vapor phase selected from the group consisting of tri-tertiary-butylphenol phosphate esters and compounds having the formula I:

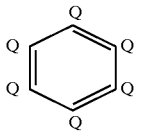

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

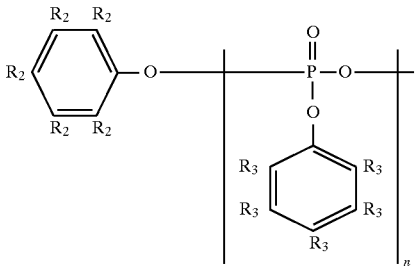

II wherein $R_2$ and $R_3$ are the same as R and only one or two occurrences of each of $R_2$ and $R_3$ may be alkyl, and "n" is a whole number of from 1 to 9, and mixtures thereof, wherein said antifoulant is added to said hydrocarbon equipment, either on a continuous or intermittent basis, through an injection quill, wherein said injection quill is maintained at a temperature of at least about 240° C. in order to vaporize the antifoulant prior to the antifoulant contacting the surfaces of the processing equipment, and wherein said hydrocarbon processing equipment is maintained at a temperature of at least about 240° C. during addition of said antifoulant.

2. The method according to claim 1, wherein said antifoulant is added to a carrier selected from the group consisting of: steam; air; hydrocarbon gases; and inert gases and, mixtures thereof, wherein said antifoulant is added to said carrier through an injection quill, wherein said injection quill is maintained at a temperature of at least about 240° C. to vaporize said antifoulant and wherein said carrier containing said antifoulant is either added to a hydrocarbon fluid prior to said hydrocarbon fluid contacting the high temperature sections of the hydrocarbon processing equipment or said carrier is injected into the high temperature sections of the hydrocarbon processing equipment when a hydrocarbon fluid is not being processed or said carrier is injected into the high temperature sections of the hydrocarbon processing equipment both prior to and during the processing of a hydrocarbon fluid, wherein said high temperature section of the hydrocarbon processing equipment is at a temperature of at least about 240° C.

3. The method according to claim 2, wherein said carrier containing said antifoulant is added to a hydrocarbon fluid wherein said antifoulant is added to said hydrocarbon fluid in an amount of from about 5 parts per million to about 2,000 parts per million based on the mass of the hydrocarbon fluid.

4. The method according to claim 1, wherein said hydrocarbon processing equipment is selected from the group consisting of: visbreakers; delayed cokers; preheaters; furnaces; transfer lines; exchangers; fluid catalytic crackers; hydrotreaters; hydrocrackers; and, furnace coils.

5. The method according to claim 1, wherein "n" is a whole number of from 1 to 5.

6. The method according to claim 5, wherein "n" is a whole number of from 1 to 3.

7. The method according to claim 6, wherein "n" is 1.

8. The method according to claim 7, wherein each occurrence of R, $R_2$, and $R_3$ is hydrogen.

9. The method according to claim 1, wherein R is a hydrogen or an alkyl group containing from 1 to 4 carbon atoms with at least one occurrence of R being alkyl.

10. The method according to claim 2, wherein said antifoulant is added to the carrier stream prior to the introduction of said carrier stream into an ethylene furnace.

11. The method according to claim 2, wherein said antifoulant is added to the carrier stream prior to the introduction of said carrier stream into a visbreaker.

12. A method for inhibiting the formation of coke on the surfaces of high temperature sections of hydrocarbon processing equipment in contact with hydrocarbon fluid which comprises:

a. decoking the hydrocarbon processing equipment;

b. prior to processing a hydrocarbon fluid, adding to the processing equipment an antifoulant in its vapor phase, wherein said antifoulant is added to said hydrocarbon processing equipment through one or more injection quills with said injection quills being maintained at a temperature of at least about 240° C. in order to vaporize said antifoulant, and wherein said antifoulant is selected from the group consisting of:

1. tri-tertiary-butylphenol phosphate esters;

2. compounds having the formula I:

I

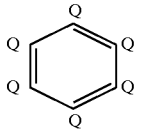

wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

II

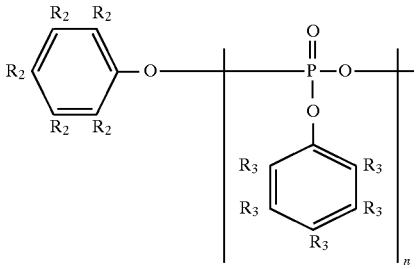

wherein $R_2$ and $R_3$ are the same as R and only one or two occurrences of each of $R_2$ and $R_3$ may be alkyl, and "n" is a whole number of from 1 to 9; and, 3. mixtures thereof;

c. forming a thin coke layer on the surfaces of the processing equipment; and then, d. feeding the hydrocarbon fluid to the processing equipment.

13. The method according to claim 12, wherein the addition of the antifoulant is discontinued during the processing of the hydrocarbon fluid.

14. The method according to claim 12, wherein the addition of the antifoulant is discontinued prior to the processing of the hydrocarbon fluid.

15. The method according to claim 12, wherein the antifoulant is added intermittently prior to the processing of the hydrocarbon fluid.

16. The method according to claim 12, wherein the antifoulant is added continuously prior to the processing of the hydrocarbon fluid.

17. The method according to claim 12, wherein the antifoulant is added intermittently during the processing of the hydrocarbon fluid.

18. The method according to claim 12, wherein the antifoulant is added continuously during the processing of the hydrocarbon fluid.

19. The method according to claim 12, wherein the hydrocarbon fluid contains at least one fraction selected from the group consisting of:

a. ethane;

b. propane;

c. butane;

d. naphtha;

e. kerosene;

f. gas oil; and, g. residue.

20. The method according to claim 12, wherein said antifoulant is added to the processing equipment in a carrier stream, wherein said carrier stream is selected from the group consisting of:

a. steam;

b. air;

c. hydrocarbon gases;

d. inert gases; and, e. mixtures thereof.

21. The method according to claim 20, wherein the antifoulant is added in a range of from about 0.0005% by volume to about 10% by volume on the basis of carrier volume flow prior to the processing of the hydrocarbon fluid.

22. The method according to claim 12, wherein the antifoulant is added in a range of from about 5 ppm to about 2,000 ppm on the basis of hydrocarbon fluid mass flow during the processing of the hydrocarbon fluid.

23. The method according to claim 12, wherein, during the addition of the antifoulant, the processing equipment is maintained at a temperature of at least about 240° C.

24. The method according to claim 12, wherein, during the addition of the antifoulant, the processing equipment is maintained at a temperature ranging from about 200° C. to about 1,200 ° C.

25. A method for inhibiting the formation of coke on the surfaces of high temperature sections of hydrocarbon processing equipment in contact with hydrocarbon fluid which comprises:

a. processing of a hydrocarbon fluid in the presence of an antifoulant wherein said antifoulant is in its vapor phase, wherein said antifoulant is added to said hydrocarbon equipment, either on a continuous or intermittent basis, through an injection quill, wherein said injection quill is maintained at a temperature of at least about 240° C. in order to vaporize the antifoulant prior to the antifoulant contacting the surfaces of the process equipment, and wherein said hydrocarbon processing equipment is maintained at a temperature of at least about 240° C. during addition of said antifoulant, with said antifoulant being selected from the group consisting of:

1. tri-tertiary-butylphenol phosphate esters;

2. compounds having the formula I:

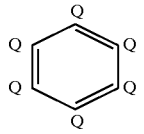

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

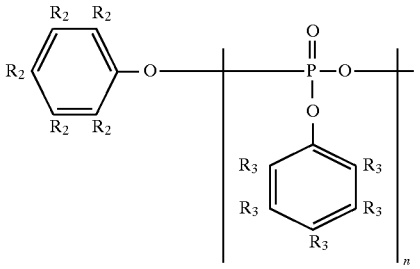

II wherein $R_2$ and $R_3$ are the same as R and only one or two occurrences of each of $R_2$ and $R_3$ may be alkyl, and "n" is a whole number of from 1 to 9; and, mixtures thereof, and, 3. mixtures thereof; and b. forming a thin coke layer on the surfaces of the processing equipment, whereby the surfaces of the processing equipment are inhibited against formation of additional coke during the processing of a hydrocarbon fluid.

26. The method according to claim 25, wherein the antifoulant is added intermittently during the processing of the hydrocarbon fluid.

27. The method according to claim 25, wherein the antifoulant is added continuously during the processing of the hydrocarbon fluid.

28. The method according to claim 25, wherein the hydrocarbon fluid contains at least one fraction selected from the group consisting of:

a. ethane;

b. propane;

c. butane;

d. naphtha;

e. kerosene;

f. gas oil; and, g. residue.

29. The method according to claim 25, wherein the antifoulant is added in a range of from about 5 ppm to about 2,000 ppm on the basis of hydrocarbon fluid mass flow during the processing of the hydrocarbon fluid.

30. The method according to claim 25, wherein during the addition of the antifoulant, the processing equipment is maintained at a temperature of at least about 240° C.

31. A method for increasing the run length of hydrocarbon processing equipment used to process a hydrocarbon fluid which comprises:

a. decoking processing equipment;

b. prior to processing a hydrocarbon fluid, adding to the processing equipment an antifoulant in its vapor phase wherein said antifoulant is added to said hydrocarbon equipment, either on a continuous or intermittent basis, through an injection quill, wherein said injection quill is maintained at a temperature of at least about 240° C. in order to vaporize the antifoulant prior to the antifoulant contacting the surfaces of the process equipment, and wherein said hydrocarbon processing equipment is maintained at a temperature of at least about 240° C. during addition of said antifoulant, wherein said antifoulant is selected from the group consisting of:

1. tri-tertiary-butylphenol phosphate esters;

2. compounds having the formula I:

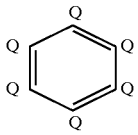

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

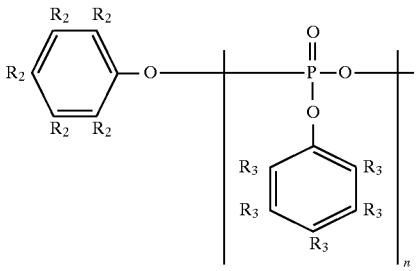

II wherein $R_2$ and $R_3$ are the same as R and only one or two occurrences of each of $R_2$ and $R_3$ may be alkyl, and "n" is a whole number of from 1 to 9; and, 3. mixtures thereof, c. forming a thin coke layer on the surfaces of the processing equipment in contact with the hydrocarbon fluid; and then, d. feeding the hydrocarbon fluid to the processing equipment, whereby the surfaces of said processing equipment are inhibited against formation of additional coke during the processing of the hydrocarbon fluid thereby increasing the run length of the processing equipment.

32. A method for increasing the product yield from the processing of a hydrocarbon fluid through hydrocarbon processing equipment which comprises:

a. decoking processing equipment;

b. prior to processing a hydrocarbon fluid, adding to the processing equipment an antifoulant in its vapor phase, wherein said antifoulant is added to said hydrocarbon equipment, either on a continuous or intermittent basis, through an injection quill, wherein said injection quill is maintained at a temperature of at least about 240° C. in order to vaporize the antifoulant prior to the antifoulant contacting the surfaces of the process equipment, and wherein said hydrocarbon processing equipment is maintained at a temperature of at least about 240° C. during addition of said antifoulant, wherein said antifoulant is selected from the group consisting of:

1. tri-tertiary-butylphenol phosphate esters;

2. compounds having the formula I:

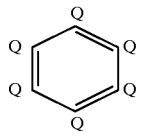

I wherein

Q is selected from the group consisting of: Z and R, wherein two occurrences of Q are Z, and wherein R is hydrogen, or a straight or branched alkyl group having from 1 to 7 carbon atoms, and only one or two occurrences of R may be alkyl;

Z is represented by the formula II:

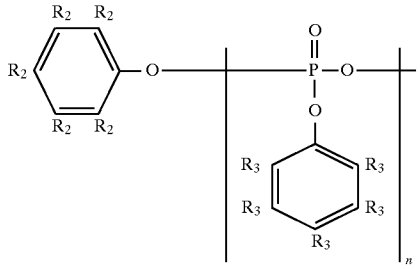

II wherein $R_2$ and $R_3$ are the same as R and only one or two occurrences of each of $R_2$ and $R_3$ may be alkyl, and "n" is a whole number of from 1 to 9; and, 3. mixtures thereof;

c. forming a thin coke layer on the surfaces of the processing equipment in contact with the hydrocarbon fluid; and then, d. feeding the hydrocarbon fluid to the processing equipment, whereby the surfaces of said processing equipment are inhibited against formation of additional coke during the processing of the hydrocarbon fluid thereby increasing the product yield from the processing of the hydrocarbon fluid through the processing equipment.

* * * * *